US005923004A

United States Patent [19]

Whitehall et al.

[11] Patent Number: 5,923,004

[45] Date of Patent: Jul. 13, 1999

[54] METHOD FOR CONTINUOUS LEARNING BY A NEURAL NETWORK USED IN AN ELEVATOR DISPATCHING SYSTEM

[75] Inventors: Bradley L. Whitehall, Menomonee Falls, Wis.; Theresa M. Christy, West Hartford; Bruce A. Powell, Canton, both of Conn.

[73] Assignee: Otis Elevator Company, Farmington, Conn.

[21] Appl. No.: 09/000,748

[22] Filed: Dec. 30, 1997

[51] Int. Cl.[6] ..... B66B 1/18

[52] U.S. Cl. ..... 187/382; 187/393

[58] Field of Search ..... 187/380, 382, 187/391, 393

[56] References Cited

U.S. PATENT DOCUMENTS

| | | | |
|---|---|---|---|
| 4,815,568 | 3/1989 | Bittar | 187/127 |
| 5,146,053 | 9/1992 | Powell et al. | 187/127 |
| 5,306,878 | 4/1994 | Kubo | 187/127 |
| 5,388,668 | 2/1995 | Powell et al. | 187/387 |
| 5,586,033 | 12/1996 | Hall | 364/424.07 |
| 5,672,853 | 9/1997 | Whitehall et al. | 187/380 |
| 5,729,623 | 3/1998 | Omatu et al. | 382/155 |
| 5,767,461 | 6/1998 | Nakagawa et al. | 187/382 |

FOREIGN PATENT DOCUMENTS 0676356 10/1995 European Pat. Off. .

OTHER PUBLICATIONS

"Neural Networks: An Introduction", B. Muller et al, Springer–Verlag Berlin/Heidelberg, 1990, Sec. 5.2.1, pp. 46–47.

*Primary Examiner*—Robert E. Nappi

[57] ABSTRACT

A method for training a neural network used to estimate for an elevator the remaining response time for the elevator to service a hall call. The training, which results in adjusting connection weights between nodes of the neural network, is performed while the elevator is in actual operation. The method is not restricted to any particular architecture of neural network. The method uses a cutoff to limit changes to the connection weights, and provides for scaling the different inputs to the neural network so that all inputs lie in a predetermined range. The method also provides for training in case the elevator is diverted from servicing the hall call by an intervening hall call.

7 Claims, 3 Drawing Sheets

METHOD FOR CONTINUOUS LEARNING BY A NEURAL NETWORK USED IN AN ELEVATOR DISPATCHING SYSTEM

BACKGROUND OF THE INVENTION

1. Technical Field

The present invention pertains to the field of elevator control. More particularly, the present invention pertains to varying weights of a neural network used to calculate the remaining response time for an elevator to service a hall call.

2. Description of Related Art

Elevator dispatching systems use a number of factors in determining which car is the most appropriate to service a request (hall call). Since conditions are constantly changing, such systems evaluate and reevaluate the best car to serve a hall call "on-the-fly", so that a final selection need not be made until the last possible moment. See, e.g., U.S. Pat. No. 4,815,568 to Bittar. The control parameter remaining response time (RRT) may be defined as the estimated time for a car to travel from its current position to the floor with outstanding hall call. This control parameter is a critical element in determining which car is the most appropriate car to service a request. See, e.g., U.S. Pat. No. 5,146,053 to Powell.

Artificial neural networks have recently been applied to the problem of estimating RRT. See, e.g., U.S. Pat. No. 5,672,853 to Whitehall et al. Neural networks have proven useful in estimating RRT, but in implementations so far, the neural networks have had to be trained before being put to use. Usually, training is performed off-line, before the elevator is put into operation. Data is logged during the operation of the elevator system without the neural network, and then used to train the neural network for future use in estimating RRT. Once the neural network is put into operation with the elevator, the neural network is static. In other words, if the building population changes or traffic patterns change, the neural network will not adapt unless it is taken off line and retrained.

What is needed is a way of implementing a neural network so that it can be trained continuously, allowing it to adjust to changes in how the elevator is used.

SUMMARY OF THE INVENTION

The present invention is a method of continuously training a neural network for use in estimating remaining response time (RRT) of an elevator to service a hall call while the elevator is in actual operation. According to the present invention, a neural network is implemented with weights determined initially by some method not limited by the present invention. For example, the weights can be assigned initial values by providing the neural network with training data collected in earlier operation of the elevator, and this training data can be used to adjust the weights of the neural network according to a learning algorithm appropriate to the type of neural network implemented. Then, the neural network is put into service with the elevator, and the weights are readjusted after the elevator services each new hall call. The adjustment uses a pre-set learning rate and the difference between the RRT observed when the elevator actually services the assigned hall call and the RRT estimated by the neural network.

The method accounts for intervening hall calls; it is possible, for example, for the elevator to be assigned a service a hall call while in route to servicing an earlier assigned hall call, and served before the elevator services the earlier hall call. In the preferred embodiment, the RRT estimated for the earlier hall call is recalculated after the neural network weights are adjusted for the intervening (and first served) hall call.

Further according to the present invention, the inputs to the neural network are scaled so as to all lie within one range, in order to avoid one input numerically overwhelming another input, purely on account of the arbitrary scales used for the different inputs. Finally, according to the present invention, the change in a weight as a result of comparing the estimated with the observed RRT is limited by a cutoff. Using a cutoff prevents drastic changes to weights caused by an unusually long observed RRT leading to a large error in predicting the RRT.

In one aspect of the present invention, a simple perceptron is used as the neural network, i.e. a neural network without any hidden layers between the input and output layers. A general feed-forward neural network is shown in FIG. 1*a* and includes an input layer of more than one node, an output layer of at least one node, and one or more middle or hidden layers of several nodes each. The state of each node is some activation function of the inputs to the node, and the state of each node of one layer is sensed by all nodes of the next layer on the way to the output layer (i.e. the state values are fed forward) according to weights that may differ for each node of the next layer, or from any of the other weights of the neural network.

A simple perceptron, shown in FIG. 1*b*, is a feed-forward neural network that includes only an input layer of at least two nodes and an output layer of at least one node. The state of each input node is sensed by the output node according to a weight assigned to the state of the input node. In the case of a simple perceptron neural network having one output node, the neural network output is simply the state of the single output node, and may be merely the weighted sum of the states of each input node.

In general, the neural network weights are adjusted until sets of inputs produce outputs in reasonable accord with values observed to correspond to the sets of inputs. See, for example, *Neural Networks*, by B. Miller and J. Reinhardt, copyright 1990, Section 5.2.1.

BRIEF DESCRIPTION OF THE DRAWINGS

The above and other objects, features and advantages of the invention will become apparent from a consideration of the subsequent detailed description presented in connection with the accompanying drawings, in which.

BEST MODE FOR CARRYING OUT THE INVENTION

The method of the present invention provides for continuous learning by a neural network used with an elevator to estimate the remaining response time (RRT) for servicing a hall call when a controller is determining whether to assign the hall call to the elevator.

Figure 1A:
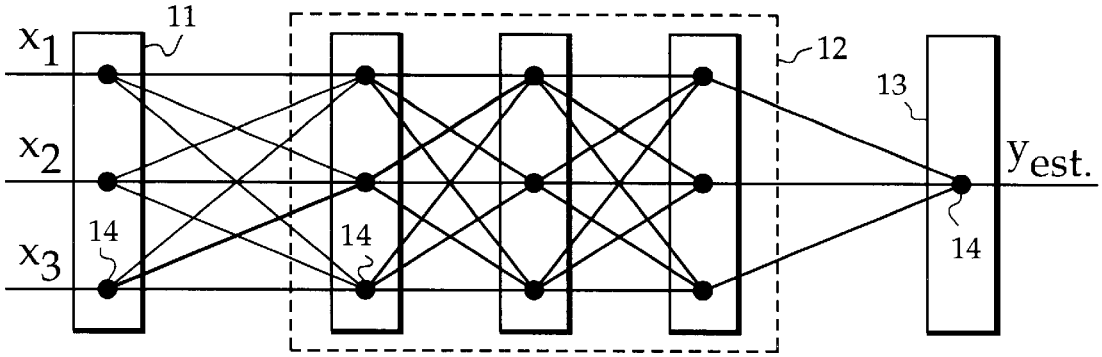
FIG. 1a (PRIOR ART)
FIGS. 1*a* and 1*b* are representations of a general feed-forward neural network and a simple perceptron neural network, respectively.

The method is not intended to be restricted to a neural network of any particular architecture. For example, the method of the present invention could be used with a general feed-forward neural network such as shown in FIG. 1*a*. In that case, the neural network would include an input layer 11, hidden layers 12 and an output layer 13, each layer including one or more nodes 14. In a general feed-forward neural network, each node 14 is connected with every node of the next layer. Each node assumes a particular state based on inputs to that node and based on an activation function of the inputs to that node. The state of the node is then propagated to each node of the next layer by links, but with a weight associated with each link. It is these weights that are adjusted to provide that certain inputs ultimately produce particular output states of the neural network.

How these weights are adjusted is the subject of much study, and usually depends on the architecture of the network, in particular, whether there are hidden layers. The particular learning algorithm used and the particular architecture of the neural network used is not a limitation of the present invention.

Figure 1B:
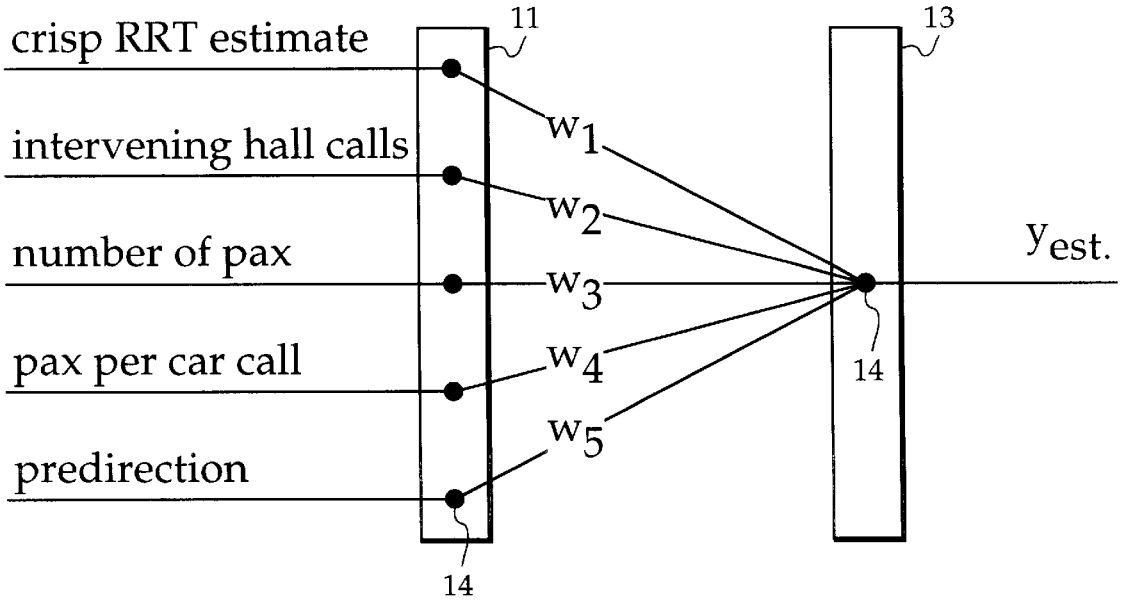
FIG. 1b (PRIOR ART)

Without loss of generality, the present invention will be described here in terms of a simple perceptron neural network such as shown in FIG. 1*b*. There, the input layer 11 includes several nodes each having one input. Each node assumes a certain output based on an activation function of its input. The output state of each node 14 is propagated to a node 14 of the output layer 13. The state of the output node 14 of output layer 13 is RRT estimated by the neural network, and is intended to be a good prediction of the observed RRT.

Assuming for illustration a simple perceptron with five inputs as shown in FIG. 1*b*, the state y of the output node 14 of the output layer 13 is the value of an activation function $\phi$ of the weighted sum of the output states $x_i$ of each input node, the weighting according to the values $w_1, \ldots, w_5$, i.e., $$y = \varphi\left(\sum_{i=1}^{5} w_i x_i\right).$$

As will be described below, in the preferred embodiment using a simple perceptron, the output state of each input node is simply the scaled input. In the preferred embodiment, the activation function is assumed to be merely the linear mapping $\phi(x)=x$, so that:

$$y = \sum_{i=1}^{5} w_i x_i.$$

In another aspect of the present invention, as discussed below, the activation function can be a scaling function that maps the summation to a pre-determined range. Training of the simple perceptron neural network adjusts the weights $w_i$ to achieve a good match between the estimated RRT, provided as the output state y of the neural network, and the observed RRT.

Some particular inputs to a neural network used in an elevator dispatching system might include, as shown in FIG. 1*b*, a so-called crisp RRT estimate, i.e., an RRT estimate made by using a conventional formula for RRT; the number of intervening hall calls between the cars current position and the candidate hall call, this number ranging from zero to twice the number of landings; the number of passengers (pax), the number of passengers per car called; and the predirection of the car at the time of the hall call, i.e., whether the elevator at the time of the hall call is traveling up or down, or is at rest.

Figure 2:
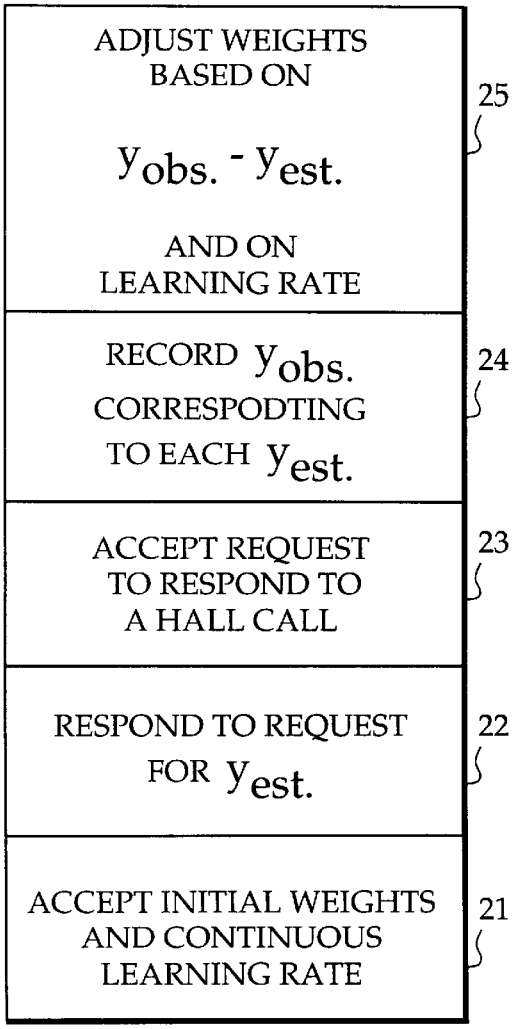
FIG. 2 is a structure diagram showing various components of an implementation of the method of the present invention.

Referring now to FIG. 2, the method of the present invention is shown in terms of the components of an implementation in an elevator system. Modulus 21 provides for inputting to the implementation the initial weights and continuous learning rate, both needed from the very beginning of use. The continuous learning rate r of the neural network is used to control the effect on changes to the existing values of the weights caused by a newly observed RRT. In the case of a simple perceptron, the weights may be adjusted based on the learning rate r using the learning rule:

$$w_j(n+m)=w_j(n)+r[y_{obs}(n)-y_{est}(n)]x_j(n)$$

where the arguments n and n+m of the connection weights $w_j$ indicate values before and after servicing the $n^{th}$ hall call, respectively; the $Y_{est}$ and $Y_{obs}$ values are both for the $n^{th}$ hall call, and the $x_j$ value is the input to the $j^{th}$ node at the time of the $n^{th}$ hall call. The time referred to by n+m is the time of a later hall call, the $(n+m)^{th}$ hall call; m=1 if there are no intervening hall calls.

Modulus 22 provides the elevator dispatcher, which is separate from the implementation of the present invention, with an estimated RRT for responding to a new hall call. The elevator dispatcher uses this value, designated $Y_{est}$, in deciding whether to assign the new hall call to the elevator; a value of $y_{est}$ is determined by the modulus 22 using the present values of the weights $w_i$, which may have been changed from the values provided initially as a result of continuous learning.

Modulus 23 provides for accepting an assignment to service a hall call, and in so doing makes ready for recording the actual, observed RRT for the hall call so that it may be compared with the RRT estimated for the hall call. Modulus 23 also records the inputs to the neural network at the time of the hall call for use in later adjusting the connection weights. Before the elevator services the hall call, however, it may be assigned one or more intervening hall calls, i.e. while the elevator is in route to service the first assigned hall call.

Modulus 24 provides for the implementation to record the RRT observed for a hall call, designated $Y_{obs}$. The implementation must correctly associate each $Y_{obs}$ with the corresponding $Y_{est}$ so that the weights of the neural network can be properly adjusted, by accounting for the difference between the actual and observed RRT for each particular hall call.

Modulus 25 provides for adjusting the weights of the neural network based on the observed RRT and the estimated RRT for a hall call, and using the continuous learning rate r. This modulus may be called into use even when there are outstanding hall calls, i.e. hall calls yet to be serviced. It is used, in the preferred embodiment, as soon as any hall call is serviced. As explained below, the method of the present invention, in the preferred embodiment, recalculates $Y_{est}$ of a first hall call whenever the weights are adjusted, in response to a second hall call, between when the first hall call is assigned and when it is serviced. This recalculation is performed because $Y_{est}$ is calculated using the values of the weights at the time the dispatcher is deciding whether to assign a hall call.

However, as the values of the weights converge to values that are stable for the existing pattern of elevator use, there is less of a need to recalculate $Y_{est}$ based on intervening servicing of hall calls, because the changes to the weights from any hall call will be small, and the effect of the intervening hall calls is really only a difference in the calculated changes to the weights. In other words, accounting properly for servicing intervening hall calls has only a second order effect.

Figure 3:
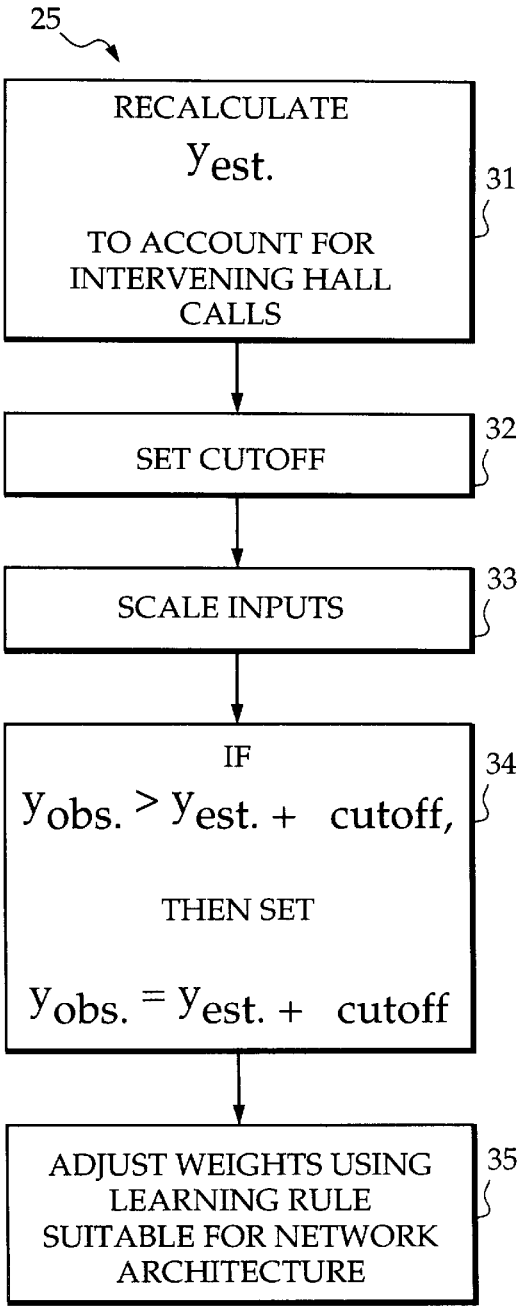
FIG. 3 is a process diagram showing the method of the present invention.

Referring now to FIG. 3, the method of the present invention is shown, beginning with first step 31, which accounts for the effect on changes to the weights of servicing an intervening hall call. In step 31, the estimated RRT is recalculated using the weights adjusted on account of servicing any intervening hall calls. It is possible, to implement this method without step 31, because the effect on calculating changes to the weights of servicing an intervening hall call is of second order. In implementations where the recalculation does not consume significant resource, the method of the present invention could always begin with a recalculation of the $Y_{est}$ for the hall call just serviced.

Figure 4:
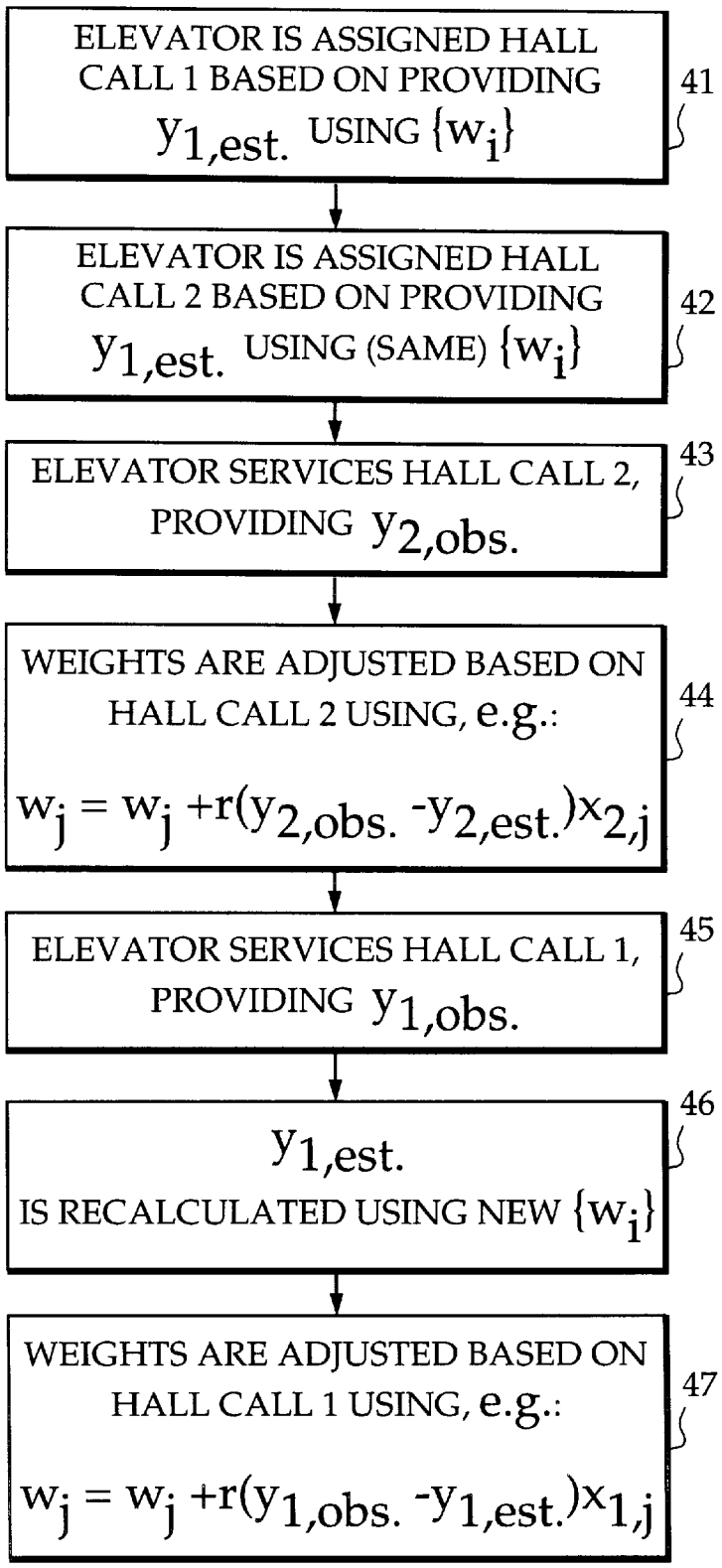
FIG. 4 is a scenario diagram illustrating how the method of the present invention is used in case of one kind of intervening hall call.

FIG. 4 graphically illustrates the operation of step 31 in recalculating the estimated RRT to account for servicing an intervening hall call when the intervening hall call is assigned after a first hall call, but serviced before the first hall call. The sequence of events represented in the scenario steps 41–47 shown in FIG. 4 may be indicated as:

$$h1, h2, s1, s2.$$

i.e. hall call 1 is assigned, then hall call 2 is assigned, then hall call 1 is serviced, and finally hall call 2 is serviced. Here, $y_{est}$, corresponding to hall call 2 should be recalculated to account for changes to the weights made after servicing hall call 1. The other possibility involving only two hall calls in which step 31 would come into play is the sequence:

$$h1, h2, s2, s1.$$

Here, step 31 would recalculate $y_{est}$ corresponding to hall call 1.

After accounting for intervening hall calls, control moves to the step 32 of setting a cutoff so that the observed RRT used in the formula for adjusting weights will never differ by more than the cutoff from the estimated RRT. This cutoff can be set one time only, or can be adjusted periodically during operation of the elevator.

Control then passes to the step 33 of scaling the inputs so that all inputs lie in the same range, and the effect of a choice of units on the performance of the network is eliminated. The scaling function maps the raw input range [a, b] to the scaled range $[a_s, b_s]$ so that an unsealed value $x_{u,i}$ in the raw input range is transformed to a scaled value $x_i$ in the scaled range according to the formula $$x_i = \frac{(b_s - a_s)x_{u,i} + (ba_s - ab_s)}{b - a}$$

A similar mapping can be used to scale the output, forcing the output to a particular allowed range of values. The scaling of the inputs may be considered as an activation function for the neurons of the input layer. In other words, the scaled inputs are really the states of the neurons of the input layer.

After scaling the inputs, control moves to the step 34 in which the output error, i.e., the magnitude of the difference between the observed and estimated RRT, is compared with a pre-determined cutoff. If it is, then the observed RRT is diminished so that it exceeds the estimated RRT by only the cutoff value.

In last step 35, the weights are adjusted based on the difference between the observed and estimated RRT using the learning rate r and, in the case of a simple perceptron neural network, according to the learning rule recited above:

$$w_j(n+1)=w_j(n)+r[y_{obs}(n)-y_{est}(n)]x_j(n)$$

where the $x_j$ are the scaled inputs, and, if the output is scaled, the $Y_{est}$ and $Y_{obs}$ are scaled values. In the case of a more general feed-forward network, the learning rule would differ. For example, the gradient rule could be used advantageously in case of using a neural network with hidden layers.

It is to be understood that the above-described arrangements are only illustrative of the application of the principles of the present invention. In particular, the term continuous as used here is not intended to limit the present invention to updating weights of an elevator neural network after servicing every hall call; the updating could be performed less frequently. Numerous modifications and alternative arrangements may be devised by those skilled in the art without departing from the spirit and scope of the present invention, and the appended claims are intended to cover such modifications and arrangements.

What is claimed is:

1. A method for training a neural network used to calculate an estimated remaining response time(RRT) for an elevator car to serve a hall call, the estimated RRT measured from a given time for predicting a corresponding observed RRT, the neural network having a particular architecture and having weights with initial values, the neural network also having various inputs, the method comprising the steps of:

(a) scaling the inputs to the neural network so that said inputs fall within a pre-determined input range;

(b) determining whether an observed RRT, corresponding to an estimated RRT and so measured from the same given time, exceeds a maximum allowable RRT value, and if so, using for the observed RRT the maximum allowable RRT value; and (c) adjusting the weights of the network using a learning rule suitable for the network architecture;

wherein the learning rule accounts for how the observed RRT differs from the corresponding estimated RRT, whereby the neural network is trained continuously during operation of the elevator.

2. The method of claim 1, wherein in case of calculating an estimated RRT for an elevator car to service a first hall call and then, after calculating the estimated RRT for the first hall call and before servicing the first hall call, having the elevator car assigned an intervening hall call, re-calculating the estimated RRT for servicing either the first hall call or the intervening hall call, whichever is serviced later, to account for how training with the observed RRT of either the first hall call or the intervening hall call, whichever is serviced earlier causes a change in the weights of the neural network.

3. The method of claim 2, further comprising the step of adjusting the observed remaining response time so that its value never exceeds the estimate remaining response time by more than a predetermine cutoff.

4. The method of claim 3, wherein the neural network uses a continuous learning rate r to control how the weights are adjusted in response to each observed RRT compared to each corresponding estimated RRT, and wherein the neural network is a simple perceptron having a plurality of input nodes, each input node having a weight $[w_1(n), \ldots w_m(n)]$ $w_j(n)$ associated with a state $x_j(n)$ when an $n^{th}$ hall call is assigned, and further wherein, using $y_{obs}(n)$ for the observed RRT for the $n^{th}$ hall call and $y_{est}(n)$ for the estimated RRT for the $n^{th}$ hall call [is $Y_{est}(n)$], the weights are adjusted using as a learning rule:

$$w_j(n+1)=w_j(n)+r[y_{obs}(n)-y_{est}(n)]x_j(n)$$

for j=1, . . . , m, where $$y_{est} = \sum_{i=1}^{m} w_i x_i.$$

5. The method of claim 4, wherein the state $x_i(n)$ of an input node is the input to the input node mapped to a predetermined range by a linear function.

6. The method of claim 1, wherein the neural network uses a continuous learning rate r to control how the weights are adjusted in response to each observed RRT compared to each corresponding estimated RRT, and wherein the neural network is a simple perceptron having a plurality of input nodes, each input node having a weight $w_j(n)$ associated with a state $x_j(n)$ when an $n^{th}$ hall call is assigned, and further wherein, using $Y_{obs}(n)$ for the observed RRT for the $n^{th}$ hall call and $y_{est}(n)$ for the estimated RRT for the $n^{th}$ hall call, the weights are adjusted using as a learning rule:

$$w_j(n+1)=w_j(n)+r[y_{obs}(n)-y_{est}(n)]x_j(n)$$

for j=1, . . . , m, where $$y_{est} = \sum_{i=1}^{m} w_i x_i.$$

7. The method of claim 6, wherein the state $x_i(n)$ of an input node is the input to the input node mapped to a predetermined range by a linear function.

* * * * *